United States Patent [19]

Kaufmann et al.

[11] Patent Number: 4,743,394

[45] Date of Patent: May 10, 1988

[54] CONCENTRATED NON-PHOSPHATE DETERGENT PASTE COMPOSITIONS

[76] Inventors: Edward J. Kaufmann, 3704 Andalucia Ct., San Ramon, Calif. 94583; Gregory van Buskirk, 893 Richard La., Danville, Calif. 94526; Robert J. Iliff, 4303 Redwood Dr., Oakley, Calif. 94561; Chihae Yang, 3920 Vineyard Ave., Pleasanton, Calif. 94566

[21] Appl. No.: 831,774

[22] Filed: Feb. 20, 1986

Related U.S. Application Data

[63] Continuation-in-part of Ser. No. 592,660, Mar. 23, 1984, abandoned.

[51] Int. Cl.[4] ..... C11D 1/72; C11D 3/12; C11D 17/00

[52] U.S. Cl. ..... 252/90; 252/92; 252/135; 252/174.14; 252/174.12; 252/174.19; 252/174.21; 252/174.22; 252/174.25; 252/546; 252/DIG. 2; 252/DIG.14

[58] Field of Search ..... 252/89.1, 174.25, 174.21, 252/174.22, 131, 154, DIG. 14, 90, 92

[56] References Cited

U.S. PATENT DOCUMENTS

| | | | |
|---|---|---|---|
| 3,169,930 | 2/1965 | Gedge | 252/137 |
| 3,284,364 | 11/1966 | Siegele | 252/132 |
| 3,300,546 | 1/1967 | Baechtold | 260/876 |
| 3,374,195 | 3/1968 | Bianco et al. | 260/29.6 |
| 3,413,229 | 11/1968 | Bianco et al. | 252/90 |
| 3,630,929 | 12/1971 | Van Dijk | 252/136 |
| 3,749,675 | 7/1973 | Cheng | 252/135 |
| 3,752,857 | 8/1973 | Milligan | 260/615 |
| 3,892,905 | 7/1975 | Albert | 428/220 |
| 3,904,685 | 9/1975 | Shahidi et al. | 260/537 N |
| 3,925,224 | 12/1975 | Winston | 252/89 |
| 3,985,669 | 10/1976 | Krummel et al. | 252/116 |
| 4,101,457 | 7/1978 | Place et al. | 252/559 |
| 4,115,292 | 9/1978 | Richardson et al. | 252/90 |
| 4,115,308 | 9/1978 | Guerry | 252/135 |
| 4,162,987 | 7/1979 | Maguire et al. | 252/135 |
| 4,201,686 | 5/1980 | Augustijn | 252/174.22 |
| 4,216,125 | 8/1980 | Campbell et al. | 252/527 |
| 4,231,887 | 11/1980 | Denny et al. | 252/174.19 |
| 4,248,911 | 2/1981 | Wixon | 427/214 |
| 4,264,464 | 4/1981 | Gangwisch et al. | 252/91 |
| 4,264,466 | 4/1981 | Carleton et al. | 252/99 |
| 4,294,718 | 10/1981 | Kaeser | 252/135 |
| 4,303,556 | 12/1981 | Llenado | 252/527 |
| 4,311,606 | 1/1982 | Kaeser | 252/135 |
| 4,311,607 | 1/1982 | Kaeser | 252/140 |
| 4,316,812 | 2/1982 | Hancock et al. | 252/99 |
| 4,318,818 | 3/1982 | Letton et al. | 252/174.12 |
| 4,326,979 | 4/1982 | Bus et al. | 252/158 |
| 4,344,871 | 8/1982 | Allaway et al. | 252/531 |
| 4,379,061 | 4/1983 | Rabitsch et al. | 252/174.18 |
| 4,379,080 | 4/1983 | Murphy | 252/526 |
| 4,404,128 | 9/1983 | Anderson | 252/546 |
| 4,405,483 | 9/1983 | Kuzel et al. | 252/140 |
| 4,406,808 | 9/1983 | Gangwisch et al. | 252/91 |
| 4,409,136 | 10/1983 | Cheng | 252/540 |
| 4,411,809 | 10/1983 | Wixon et al. | 252/91 |
| 4,440,663 | 4/1984 | Boyer et al. | 252/174.11 |
| 4,457,854 | 7/1984 | Gangwisch et al. | 252/91 |
| 4,462,804 | 7/1984 | Gangwisch et al. | 8/137 |
| 4,490,271 | 12/1984 | Spadini et al. | 252/174.23 |
| 4,510,066 | 4/1985 | Saar | 252/140 |
| 4,526,698 | 7/1985 | Kuroda et al. | 252/99 |
| 4,528,276 | 7/1985 | Campbell | 502/62 |
| 4,610,799 | 9/1986 | Wilsberg et al. | 252/90 |
| 4,626,372 | 12/1986 | Kaufmann et al. | 252/90 |
| 4,690,771 | 9/1987 | Ouhadi et al. | 252/174.21 |

FOREIGN PATENT DOCUMENTS

| | | |
|---|---|---|
| 1112534 | 11/1981 | Canada . |
| 79712 | 5/1983 | European Pat. Off. . |
| 120659 | 10/1984 | European Pat. Off. . |
| 1205711 | 9/1970 | United Kingdom . |

*Primary Examiner*—Prince E. Willis

[57] ABSTRACT

In one embodiment, the invention provides novel low-temperature-effective non-phosphate detergent paste compositions comprising:

A concentrated non-phosphate, detergent paste composition which is rapidly soluble in cold water comprising, by weight:

(a) about 10–50% of at least one nonionic surfactant;

(b) about 5–70% of at least one water insoluble non-phosphate builder;

(c) about 0–70% of at lest one water soluble non-phosphate builder;

wherein the ratio of (b+c): a is greater than or equal to about 1.0; and wherein the ratio of b:a is less than about 2.0.

The novel detergent paste compositions provide good removal of oily and particulate soils from both natural and synthetic fibers and yet surprisingly are rapidly soluble/dispersible in cold water.

Furthermore, adjuncts such as nonionic, anionic, cationic, and amphoteric surfactants; phase stabilizers; fluorescent whitening agents; anti-redeposition agents; corrosion-inhibiting agents; dyes; pigments; bleaches, fabric softeners; enzymes; and fragrances may be added to the novel paste detergents of this invention.

The invention also provides novel delivery means in the form of unit dosage size water soluble polyvinyl alcohol film packets to deliver the novel detergent paste compositions into wash water.

29 Claims, No Drawings

CONCENTRATED NON-PHOSPHATE DETERGENT PASTE COMPOSITIONS

This is a continuation-in-part of Ser. No. 592,660, now abandoned, filed Mar. 23, 1984, the specification of which is incorporated herein by reference.

TECHNICAL FIELD

The within disclosed invention relates to concentrated non-phosphate detergent paste compositions and delivery means therefor.

BACKGROUND OF THE INVENTION

It is well known to those skilled in the art that nonionic surfactants are useful in formulating laundry detergents for use in low water temperature washes. It is further known that nonionic surfactants are particularly efficient at removing oily soils from synthetic fabrics but that they are not as efficient at removing particulate soils as anionic surfactants. As a result it is desirable to include detergent builders in detergent formulations containing nonionic surfactants to improve performance on particulate soils and provide good overall cleaning performance.

Nonionic surfactants are typically combined with builders by spray-drying or agglomeration processes to make dry powdered detergents. However, the amount of nonionic surfactant that can be included in such powder detergents is limited by the amount that can be absorbed into or adsorbed onto the solid components. Agglomeration techniques usually produce dense particles that have limited capacity for absorbing nonionic surfactants and the final compositions can have poor solubility rates and flowability. Spray-drying techniques produce more porous particles that can sorb more nonionic surfactant. However, the temperatures involved in spray-drying can cause decomposition of the nonionic surfactant and it is desirable to add the nonionic surfactant in a second step if a high concentration is desired. Since the spray-drying process is energy and capital intensive, this approach results in high manufacturing costs. In addition, if certain builders are present, the spray-drying process itself can lead to the formation of insoluble particles that deposit on clothes during the washing process. In spray-drying processes, slurries are utilized which may contain builders and nonionic surfactants, but with a high amount of water (usually around 30–70%). Such slurries would themselves be unacceptable as detergents since they will have long term phase stability problems and will deliver only diluted amounts of active ingredients and the high level of water can cause chemical stability problems.

High levels of nonionic surfactants can be readily incorporated into liquid laundry detergents. However, these formulations are normally severely limited in the type and amount of builder that can be incorporated therein since the builder must be soluble or dispersible in the formulation to prevent phase separation. As a result, the overall particulate soil removal performance of liquid laundry detergents is generally poorer than that of powder detergents.

There have been attempts to combine high levels of nonionic surfactants and builders in laundry detergent formulations which have the physical form of mulls or pastes. U.S. Pat. No. 4,264,466, issued to Carleton et al, describes detergent mulls which contain chain structure clays to prevent phase separation of the liquid and solid components. Carleton et al contend that poor phase stability results if chain structure clays are omitted from their formulations. However, chain structure clays can hinder solubility of detergent compositions.

Because of the viscous nature of these paste formulations, it is difficult to deliver them into the washing machine from a conventional, liquid laundry detergent bottle, even one equipped with a pump dispenser. The use of a squeezable tube, similar to those used to dispense toothpaste, to dispense a detergent in the form of a paste may be feasible from a technical consideration, but the size of the tube required to contain a reasonable amount o detergent for multiple wash loads would make it difficult for the consumer to use conveniently.

The use of pouches constructed of water soluble films to deliver unit dosages of laundry additives is well documented. However, there has been no demonstration in the prior art of the use of such pouches to contain and deliver a composition containing a high level of nonionic surfactant. For example, U.S. Pat. No. 4,115,292, issued to Richardson et al, shows compositions with low amounts of very high pour point nonionic surfactants and relatively high amounts of water in water-soluble polyvinyl alcohol pouches.

From cleaning performance considerations, inorganic phosphates are the first choice as builders in detergent compositions. However, phosphates have been implicated in polluting lakes and streams since they promote algal growth, leading to eutrophication of free standing waters. As a result, there has been substantial legislation promulgated which restricts the use of phosphates in laundry detergents in the United States and other countries.

Sodium aluminosilicates (zeolites) have been shown to be acceptable replacements for phosphates in laundry detergent compositions. However, to be effective, they must have a particle size which is less than about 10 microns and thus, can lead to dispersibility/solubility problems, especially in compositions in the form of pastes. Solubility problems may occur because of the interactions among these particles throughout the detergent matrix.

U.S. Pat. No. 4,409,136, issued to Cheng, describes viscous pastes containing nonionic surfactant, zeolite builders and a high amount of water (at least 10% water added in addition to that contained in the zeolite; the Cheng disclosure states however, that preferably at least 25% water is added). Because of the high amount of water, these pastes will not deliver concentrated amounts of detergents in the wash water. Further, as will be disclosed in detail later, these compositions are not formulated to provide good solubility in cool and cold water washes. Also, it is desirable to include enzymes in laundry detergent compositions and it is known that the addition of water to such compositions can have negative effects on enzyme stability.

Other non-phosphate builders such as citrates, silicates and carbonates have also been used in laundry detergent compositions, but formulations based on these builders are generally less efficacious than those based on phosphates or zeolites. Further, the alkaline nature of carbonates and silicates can have deleterious effects on polyvinyl alcohol films used to package these detergents.

SUMMARY OF THE INVENTION

In order to fulfill the need for different detergent compositions which also provide concentrated amounts of surfactants and builders, it is an object of this invention to provide a concentrated, non-phosphate paste detergent.

Because the steady rise in energy costs has made energy intensive manufacturing processes much less attractive, it is an object of this invention to provide detergent paste compositions containing high amounts of nonionic surfactants which are not produced by such energy consumptive processes.

Because there has been a trend in domestic laundry towards lowered wash temperatures, it is a further object of this invention to provide detergent compositions in the form of pastes which have excellent solubility or dispersibility in cool and cold water and which efficiently remove both particulate and oily soils.

It is a still further object of this invention to provide detergent compositions in the form of pastes which have excellent rates of dispersion/dissolution in cool and cold water and which have good phase stability without the addition of substantial amounts of chain structure clays or other costly phase-stabilizing ingredients.

It is another object of this invention to provide a method for conveniently packing, storing and delivering these detergent compositions to washing machines.

In one embodiment, the invention provides novel low-temperature-effective non-phosphate detergent paste compositions comprising:

A concentrated non-phosphate, paste detergent composition which is rapidly soluble in cold water comprising, by weight:

(a) about 10–50% of at least one nonionic surfactant;

(b) about 5–70% of at least one water insoluble non-phosphate builder;

(c) about 0–70% of at least one water soluble non-phosphate builder;

wherein the ratio of (b+c): a is greater than or equal to about 1.0; and wherein the ratio of b:a is less than about 2.0.

As will be more specifically discussed herein, the novel detergent paste compositions provide good removal of oily and particulate soils from both natural and synthetic fibers and yet surprisingly are rapidly soluble/dispersible in cold water, even though the HLB values of the surfactant systems of these compositions may be lower than is considered optimum for good detergency.

The compositions of the invention have an average viscosity of about 10,000–100,000 centipoise (cps) at 25° C. and at 6.25 revolutions per minute as measured on a Haake Rotoviscometer with an MVII sensor. More preferably, the compositions of this embodiment have an average viscosity of about 20,000–60,000 cps and most preferably 30,000–50,000 cps under the same rheological test conditions.

In a still further embodiment, the invention provides a means for eliminating phase separation in these detergent paste compositions by adding about 0.1 to less than about 10.0% by weight of the composition (unless otherwise specified, all further measures herein are by percent by weight of the composition) water to the detergent paste compositions of the prior embodiments. This eliminates the need for the addition of more expensive materials, such as chain structure clays, and reduces the phase separation without significantly reducing the cold water solubility of the composition.

The preferred mode of delivery comprises packaging these non-phosphate detergent pastes in a water-soluble film package for unit dosage. Preferred films include those made from polyvinyl alcohol resins.

In one of the embodiments of this invention in which unit dosage amounts of concentrated paste detergent are packaged in convenient polyvinyl alcohol film packets, an unforeseen problem arose when highly alkaline builders constitute at least a portion of the water soluble builders of (c). It was observed that the film packets would become insoluble after contact with the detergents. Applicants surprisingly overcame this concern by limiting the amount of highly alkaline builders, if present, to no more than about 25% by weight of the total composition.

Furthermore, in any of the inventive detergent paste compositions or in the low temperature effective detergent delivery system described above, can be added further surfactants which do not render detergent solubility/dispersibility unacceptable, fluorescent whitening agents, bleaches, corrosion inhibiting agents, anti-redeposition agents, enzymes, dyes, pigments, fabric softeners, fragrances and other adjuncts.

The invention further provides a method of laundering fabrics by contacting the fabrics with the foregoing detergent paste compositions or with water into which the composition has been dissolved or dispersed.

DETAILED DESCRIPTION OF THE INVENTION

This invention relates to phase-stable, substantially non-aqueous, non-phosphate paste detergent composition that are soluble in cold water and delivery systems for these compositions. The term "paste" describes the physical form of the composition which occurs when a solid phase is dispersed in a liquid phase to result in a viscous medium. Cold water is meant to describe the temperature of water encountered by consumers when they use the cold water setting on automatic washing machines. Recent studies indicate that the temperature of the water is on the average about 65°–70° F. but can frequently reach temperatures as low as 40°–50° F.

It has been surprisingly found that some paste compositions consisting predominantly of builders and water-soluble surfactants will not dissolve at an adequate rate in cold water washes. It has been further surprisingly discovered that these compositions will dissolve at an adequate rate if two conditions are met: (1) the pour point of the surfactant system is less than the temperature of the wash water and (2) the ratio of insoluble builders to surfactant is less than about 2.0, more preferably less than about 1.5 and most preferably less than about 1.2.

As stated above, unexpectedly, only if the pour point of the nonionic surfactant system in these pastes is lower than the water temperature into which the paste is placed, will the paste dissolve/disperse at a rate sufficient to be acceptable for use as a consumer product. It is desirable to formulate these pastes with surfactant systems with pour points of less than about 65° F., more preferably less than about 60° F., even more preferably less than about 50° F. and most preferably less than about 40° F. to make them adequately soluble in most cold water washes.

A potential problem with pastes containing surfactants with low pour points is that the surfactants are too fluid at room temperature, and as a result, have more tendency to separate from the solids in the pastes. This leads to phase separation upon storage of the detergent composition. It has been surprisingly found that the addition of very small amounts of water to the surfactant system will essentially eliminate phase separation in the final detergent paste composition. Water added in the range of about 0.1 to less than 10.0%, based on the weight of composition, will adequately control phase separation without significantly reducing detergent solubility or dispersibility. This is in contrast to the disclosure in U.S. Pat. No. 4,264,466, which teaches the use of chain structure clays to prevent phase separation. These clays are more expensive to use than water and the formation of the chain structure in the paste can reduce the rate of dissolution/dispersion of the resultant detergent composition in cool water.

The amounts of builders and surfactants that can be included in the formulations disclosed herein can vary considerably depending on the nature of the builders, the final desired viscosity and the amount of water added to the surfactant system. Surprisingly, an excess of builder relative to surfactant is required to provide the desired viscosity and phase stability.

In addition, other additives commonly found in detergent compositions can also be included in the formulations described herein. These include but are not limited to further surfactants which do not render detergent dissolution/dispersion rates unacceptable, fluorescent whitening agents, bleaches, corrosion-inhibiting agents, anti-redeposition agents, enzymes, fabric softeners, perfumes, dyes and pigments.

In the invention, the builders may be water-insoluble or a combination of water insoluble and water-soluble builders. The amount of the water insoluble builder should be in the range of about 5 to 70% by weight, more preferably about 15 to 60% by weight and most preferably about 25 to 50% by weight; the water soluble builder should be in the range of 0 to 70% by weight, more preferably about 15 to 60% by weight and most preferably about 25 to 50% by weight; and the surfactant should be in the rang of about 10 to 50% by weight, more preferably about 15 to 45% by weight and most preferably about 20 to 40% by weight, of the composition and the additional optional ingredients comprising about 0 to 30% by weight of the composition, with the proviso that the ratio of the total amount of builders to surfactants be at least equal to or exceeds 1:1 and the ratio of insoluble builder to surfactant be less than about 2.0:1. More preferably, the ratio of the total amount of builders to surfactants is at least equal to or exceeds 1.5:1 and the ratio of insoluble builder to surfactant is less than about 1.5:1 and most preferably, the ratio of the total amount of builders to surfactants is at least equal to or exceeds 1.75:1 and the ratio of insoluble builder to surfactant is less than about 1.2:1.

The ratio of these ingredients should be further adjusted along with the level of water, which increases the viscosity when added to the formulation, to provide a paste composition with a viscosity preferably in the range of about 10,000 to 100,000 centipoise (cps) at 25° C. and 6.25 revolutions per minute as measured on a Haake Rotoviscometer with an MVII sensor, and more preferably in the range of about 20,000 to 60,000 cps and still more preferably in the range of about 30,000 to 50,000 cps.

Thus, the invention disclosed herein provides for paste detergent compositions that can be manufactured economically, will dissolve or disperse at acceptable rates in cool and cold water, have good overall cleaning performance and have controllable phase separation.

The individual constituents of the novel compositions of this invention are described as follows:

NONIONIC SURFACTANT

Surfactants are necessary for stain and soil removal. Nonionic surfactants are particularly suitable for use in this invention. The surfactants of choice have been selected from the nonionic surfactants including linear and branched, primary and secondary ethoxylated alcohols with an average chain length of 6 to 16 carbon atoms and averaging about 2 to 10 moles of ethylene oxide per mole of alcohol; linear and branched, primary and secondary ethoxylated, propoxylated alcohols with an average chain length of about 6 to 16 carbon atoms and averaging about 1 to 10 moles of ethylene oxide and about 1 to 10 moles of propylene oxide per mole of alcohol; linear and branched alkylphenoxy (polyethoxy) alcohols, otherwise known as ethoxylated alkylphenols, with an average chain length of 8 to 16 carbon atoms and averaging 1.5 to 30 moles of ethylene oxide per mole of alcohol; ethoxylated, propoxylated linear and branched alkylphenols, with an average chain length of 8 to 16 carbon atoms, and averaging about 1 to 10 moles of ethylene oxide and about 1 to 10 moles of propylene oxide per mole of alcohol; and mixtures thereof.

Particularly preferred examples of these nonionic surfactants are those containing about 6 to 10 moles of ethylene oxide per mole of alcohol. While the invention encompasses branched chain nonionic surfactants, it is well known that for commercial purposes, linear nonionics are preferred due to their better biodegradability. Exemplary of such surfactants are the Neodol (trade name of Shell Chemical Company) ethoxylate series. In particular, preferred surfactants include alcohol ethoxylates such as Neodol 91-6, which is a linear ethoxylated alcohol with a predominant chain length of about 9 to 11 carbons and averaging 6 moles of ethylene oxide per mole of alcohol, with a pour point of 45° F.; Neodol 91-8, having the same predominant carbon chain length as Neodol 91-6 averaging 8.4 moles of ethylene oxide per mole of alcohol, with a pour point of 60° F.; Neodol 23-6.5, which is a linear ethoxylated alcohol with a predominant chain length of about 12 to 13 carbons averaging 6.5 moles of ethylene oxide per mole of alcohol, with a pour point of 60° F.; Neodol 25-7, which is a linear ethoxylated alcohol with a predominant chain length of about 12 to 15 carbons averaging 7.2 moles of ethylene oxide per mole of alcohol, with a pour point of 70° F.; and Neodol 45-7, which is a linear ethoxylated alcohol with a predominant chain length of about 14 to 15 carbons, averaging 7 moles of ethylene oxide per mole of alcohol, with a pour point of 70° F. These particular alcohol ethoxylates are characterized by having HLB values ranging from 12.0 to about 14.0 and with hydroxyl numbers (measured in milligrams of potassium hydroxide per gram) ranging from about 132-92.

Other nonionic surfactants may be selected from the Neodol ethoxylate series containing 1-5 moles of ethylene oxide per mole of alcohol. Exemplary of these particular surfactants are Neodol 91-2.5, which is a linear ethoxylated alcohol with a predominant chain length of about 9 to 11 carbons, averaging 2.5 moles of ethylene oxide per mole of alcohol, with a pour point of 5° F., and an HLB value of about 8.1; and Neodol 25-3, which is a linear ethoxylated alcohol with a predominant chain length of 12 to 15 carbons, averaging 3 moles of ethylene oxide per mole of alcohol, with a pour point of 40° F., and an HLB value of about 7.9.

Yet another particularly preferred surfactant is Surfonic JL-80X, which is an ethoxylated, propoxylated alcohol with an average chain length of about 10 carbon atoms and averaging about 9 moles of ethylene oxide and 1.5 moles of propylene oxide per mole of alcohol, with a pour point of 15° F., and an HLB value of about 13, available from Texaco Chemical Company. Other ethoxylated, propoxylated linear alcohols which can be used to make up paste detergents which will solubilize in cold water are equally desirable and will have an average chain length of about 9–15 carbon atoms and will average 5–10 moles of ethylene oxide and 0.5–3.0 moles of propylene oxide per mole of alcohol. One further advantage of these ethoxylated, propoxylated surfactants is that they appear to exhibit little or no odor in contrast to the unpleasant odors given off by some low pour point ethoxylated linear alcohol surfactants. Ethoxylated, propoxylated alkylphenols having similar characteristics, although not as important commercially, may also serve well in this regard.

Suitable alkylphenoxy (polyethoxy) alcohols, otherwise known as ethoxylated alkylphenols, include nonyl- and octylphenoxypoly (ethyleneoxy) alcohols, such as the Igepal series manufactured by GAF Corporation, e.g., Igepal CO-210, a nonylphenol averaging 1.5 moles of ethylene oxide per mole of alcohol, and the Triton series, manufactured by Rohm and Haas Company, e.g., Triton N-57, an ethoxylated nonylphenol averaging 5 moles of ethylene oxide per mole of alcohol.

In general, the pastes of this invention have nonionic surfactants with pour points below about 65° F., more preferably below about 60° F., even more preferably less than about 50° F., and most preferably below about 40° F. Combinations of the these surfactants may be used in the detergent pastes of this invention. Preferred combinations include those which combine a surfactant with a pour point of at least about 60° F. with a surfactant with a much lower pour point such that the pour point of the combination is less than about 65° F., more preferably less than about 60° F., even more preferably less than about 50° F. and most preferably less than about 40° F. In practice, the pour point of combinations of these surfactants is usually between the pour points of each individual surfactant, but is not necessarily a weighted average of the pour points of each individual surfactant. Exemplary of these preferred combinations would include combining an ethoxylated, propoxylated surfactant, such as Surfonic JL-80X, which has a very low pour point, with a linear ethoxylated alcohol having greater detergency, such as Neodol 23–6.5. In combinations of the higher pour point surfactant (at least about 60° F.) with the lower pour point surfactant it is desirable that the higher pour point surfactant comprise no more than 50%, more preferably no more than 30% and most preferably no more than 25% of the combination.

The predominant criterion for choosing the surfactants with particular pour points is the temperature of the cold water wash into which the pastes of this invention will be placed. Cold water wash temperatures in the United States vary greatly depending on both location and time of the year. As mentioned above, the average cold water wash has been determined to be about 65° F. However, the cold water wash temperatures can actually range from about 90° F. to about 40° F. The pastes of this invention are intended to be soluble in such wash temperatures, i.e., preferably solubilize in 70° F. or lower, more preferably in 60° F. or lower, even more preferably in 50° F. and most preferably in 40° F. wash water. Therefore, the pour points of the nonionic surfactant systems within the pastes should be at least lower, more preferably about 5° F. lower, most preferably about 10° F. lower than the temperature of the wash water into which they are placed.

BUILDERS

Builders are added to detergent compositions to enhance detergency. A primary function they serve is to sequester, precipitate or otherwise complex calcium and magnesium ions to minimize their negative effect on detergency. The preferred builder in this invention is selected from the class of water insoluble aluminosilicates known as zeolites. Suitable alternative insoluble builders include agglomerated zeolites wherein the small zeolite particles are agglomerated into large porous particles with agglomerating agents such as water-soluble silicates, and ion-exchange resins such as sulfonated polystyrenes and other derivatized water-insoluble polymers.

Of the preferred insoluble builders, namely, zeolites, suitable zeolites include synthetic aluminosilicates based on the anhydrous formula $Na_2O.Al_2O_3 \times SiO_2$. These aluminosilicates include:

Zeolite A: $Na_{12}[(AlO_2)_{12}(SiO_2)_{12}].27\ H_2O$,

Zeolite X: $Na_{85}[(AlO_2)_{85}(SiO_2)_{107}].250\ H_2O$, and

Zeolite Y: $Na_{50}[(AlO_2)_{50}(SiO_2)_{142}].230\ H_2O$.

Zeolite A is available from the PQ Corp., Valley Forge, Pa., under the trademark Valfor 100. Zeolite A typically includes about 21% moisture.

In another embodiment, water soluble builders can be used in combination with the insoluble builders in these compositions. These water soluble builders include: carbonates, bicarbonates, sesquicarbonates, borates, metasilicates, silicates, polysilicates, and the alkali metal and ammonium salts of any of the foregoing. Further builders can be selected from such organic builders as polycarboxylates, polyhydroxy- sulfonates, citrates, succinates, oxydisuccinates, polyacrylic acid, nitrilotriacetic acid and ethylenediaminetetracetic acid and the alkali metal and ammonium salts of the foregoing. Mixtures of any of the builders can be used.

It is most preferred to use mixtures of (a) at least one water insoluble builder and (b) at least one water soluble builder.

Applicants surprisingly discovered that if the amount of the water insoluble builder is restricted such that it does not exceed the amount of surfactant by more than about 100%, the solubility of the composition will be maintained. More surprisingly, this relationship is essentially independent of the amount of water soluble builder or other water soluble salts that might be desired from a processing consideration.

In the embodiment of this invention in which both water insoluble and soluble builders are combined, particularly preferred soluble builders are alkaline water soluble builders. Increasing the pH of wash water is recognized to enhance soil/stain removal. However, applicants also discovered that in another of the embodiments of the invention, a paste detergent packaged in unit dosage amounts in water soluble polyvinyl alcohol packets, exceeding a certain amount of alkalinity can lead to reduction of the solubility rate of the polyvinyl alcohol film. This problem thus presents the dilemma that the higher the alkalinity is, the greater the cleaning performance, but concurrently, the greater the likelihood that the polyvinyl alcohol film used to encase the detergent will be insolubilized, preventing release of the detergent.

Surprisingly, applicants discovered that carefully controlling the alkalinity of the water soluble builders would achieve optimal cleaning and prevent the insolubilization of the polyvinyl alcohol film packet. This particular innovation comprises limiting detergent builders having high levels of active alkalinity to no more than about 25% by weight, more preferably, no more than about 20% by weight, and most preferably, no more than about 10% by weight. Compounds of active high alkalinity are those that have an active alkalinity of more than about 20%, wherein active alkalinity is defined as the alkali content as $Na_2O$ that is titratable to a phenolphthalein endpoint (about pH 8–9).

In practice, the highly active alkaline builders can be limited by "cutting" the detergent pastes with specified amounts of less alkaline water soluble builders. Here, preferred builders include sodium sesquicarbonate, sodium bicarbonates, sodium citrate, nitrilotriacetic acid, ethylenediaminetetraacetic acid ("EDTA"), polycarboxylates, polyacrylates and the salts thereof. Where a particular builder has been listed as a sodium salt, the other alkali metal and ammmonium salts thereof are also applicable.

Suitable high active alkalinity builders include sodium carbonate and sodium silicate. Sodium carbonate is available from FMC Corporation, Philadelphia, Pa. Sodium silicate is availiable from PQ Corp., Valley Forge, Pa., under the trade names Britesil C24, H20 and H24, which have $SiO_2$:$Na_2O$ ratios of 2.4:1, 2:1 and 2.4:1, respectively. Other silicates available from PQ Corp. include those sold under the trademark Metso.

Suitable non-highly active alkaline builders include: sodium sesquicarbonate (which is a mixture of sodium bicarbonate and sodium carbonate, with residual moisture) available from Church & Dwight Co., Inc., Princeton, N.J., under the trademarks Snowflake and Snowfine, and FMC Corp., Philadelphia, PA; sodium citrate, available from Miles Laboratories, Inc; and the sodium salt of nitrilotriacetic acid, available from Monsanto Chemical Corp., St. Louis, Mo. and the Hampshire Division of W.R. Grace & Co.

As previously mentioned, the combination of at least one builder and the nonionic surfactant should be readily soluble and/or dispersible in the wash water to which it is added. For the purposes of this invention, the concept of solubility includes dispersibility. For purposes of this invention, satisfactory dispersibility is obtained when an observer is unable to visually discern any localized blue residue on fabrics washed with a paste composition containing a blue dye or pigment, or in the washing machine in which these fabrics were washed.

An additional concept which is relevant to the invention is rate of dissolution/dispersion. Over time, many solid particulates will disperse in water. However, to be acceptable for use in this invention, the pastes should dissolve/disperse in water at about 70° F. within at least about 12 minutes with gentle or regular agitation, more preferably within about 10 minutes, and most preferably within about 6 minutes.

PHASE STABILIZER

Water has been used in Examples 13–22 and 26 below as a phase stabilizer and for viscosity control. In fact, in these particular uses, a chain structure clay or other thickener is not utilized nor deemed desirable. The amount of water required to produce the desired viscosity and adequate phase stability appears to show a critical range. This amount ranges from about 0.1% to less than about 10.0%, more preferably 0.1% to about 5.05% and most preferably 0.4% to about 2% by weight of the composition. Furthermore, deionized water is especially preferred for use, although from a commercial standpoint, tap water appears acceptable.

FLUORESCENT WHITENING AGENT

In the invention, fluorescent whitening agents, or brighteners, are preferably added to improve whitening of fabrics. Such fluorescent brighteners can be selected from stilbene brighteners, and their derivatives; styrylnaphthalene brighteners and their derivatives; and styrene brighteners and their derivatives. Exemplary of the derivatives used is the preferred brightener Tinopal 5BM-XC, produced by Ciba-Geigy A.G., Switzerland. Other brighteners include those disclosed in U.K. Pat. Nos. 1,298,577, 2,076,011, 2,026,054, 2,026,566, 1,393,042; and U.S. Pat. Nos. 3,951,960, 4,298,290, 3,993,659, 3,980,713 and 3,627,758, whose disclosures are incorporated herein by reference.

OPTIONAL SURFACTANTS

Further nonionic, anionic, cationic and amphoteric surfactants may be combined with the detergent pastes of this invention in a manner to impart greater cleaning where desired, with the proviso that such added surfactants do not render detergent solubility or dispersibility unacceptable, especially in cool or cold water (less than or equal to about 70° F.). For example, anionic surfactants may be added to increase cleaning of particulate soils. Suitable examples of such anionic surfactants include the ammonium, substituted ammonium (e.g., mono-, di-, and triethanolammonium), alkali metal, and alkaline earth metal salts of $C_6$–$C_{20}$ fatty acids and rosin acids, linear and branched alkylbenzenesulfonates, alkyl sulfates, alkyl ether sulfates, alkanesulfonates, olefin sulfonates, hydroxyalkanesulfonates, fatty acid monoglyceride sulfates, alkyl glyceryl ether sulfates, acyl sarcosinates, and acyl N-methyl taurides.

Further, suitable nonionic surfactants include alkyl glycosides, polyoxyethylene carboxylic acid esters, fatty acid glycerol esters, fatty acid and ethoxylated fatty acid alkanolamides, certain block copolymers of propylene oxide and ethylene oxide, and block copolymers of propylene oxide and ethylene oxide with propoxylated ethylenediamine. Also included are such semi-polar nonionic surfactants like amine oxides, Phosphine oxides, sulfoxides, and their ethoxylated derivatives.

Suitable cationic surfactants include the quaternary ammonium compounds in which typically one of the groups linked to the nitrogen atom is a $C_{12}$–$C_{18}$ alkyl group and the other three groups are short-chain alkyl groups which may bear substituents such as phenyl groups.

Further, suitable amphoteric and zwitterionic surfactants which contain an anionic water-solubilizing group, a cationic group, and a hydrophobic organic group include aminocarboxylic acids and their salts, iminodicarboxylic acids and their salts, alkylbetaines, alkylamidopropylbetaines, sulfobetaines, alkylimidazolinium derivatives, certain quaternary ammonium compounds, certain quaternary phosphonium compounds and certain tertiary sulfonium compounds. Other examples of suitable zwitterionic surfactants can be found described in U.S. Pat. No. 4,005,029, issued to Jones, at Columns 11–15, which are incorporated herein by reference.

Further examples of anionic, nonionic, cationic and amphoteric surfactants which may be suitable for use in this invention are depicted in Kirk-Othmer, *Encyclopedia of Chemical Technology,* Third Edition, Vol. 22, pages 347–387, and *McCutcheon's Detergents and Emulsifiers.* North American Edition, 1983, which are incorporated herein by reference.

FURTHER ADJUNCTS

Further cleaning adjuncts can include enzymes. Particularly preferred are amylases and proteases, and mixtures thereof. Particularly preferred are proteases such as alkaline proteases, such as those sold under the trademarks Savinase, Alcalase, and Esperase, all from Novo Industri A/S, Bagsvaerd, Denmark, and those sold under the trademarks Maxacal and Maxatase from Gist Brocades, N. V., Delft, Netherlands. Especially preferred is an amylase/protease blend, such as Maxatase MP-375, also from Gist Brocades. In fact, due to the low amount of water present in these substantially nonaqueous pastes, it is especially suitable to include these enzymes herein. It is known to those skilled in the art that high amounts of water are deleterious to enzyme activity.

Bleaches can also be added to the compositions of this invention, preferably peroxygen bleaches such as percarbonate, perborate, and the salts thereof, e.g., sodium perborate monohydrate, and organic and inorganic peroxy compounds, such as peracids, e.g., perlauric acid, and potassium peroxymonosulfate (available from E. I. Du Pont de Nemours, Delaware, under the trademark Oxone). Additionally, bleach activators may be incorporated, such as tetraacetylethylenediamine (TAED), ketones, esters or aldehydes.

Yet other common detergent additives can be included in the formulas of this invention, such as dyes, pigments and colorants, exemplary of which are ultramarine blue (UMB) pigments, anthraquinone dyes, and Monastral dyes, which are manufactured by E. I. DuPont du Nemours, Delaware. Especially preferred is UMB to impart a pleasing color to the paste composition as well as to deliver a bluing effect on fabrics. Fabric softeners may be added to the inventive pastes. These fabric softeners are generally quaternary ammonium compounds and their salts, as disclosed in U.S. Pat. Nos. 4,250,043, issued to Jones, and 4,339,335, issued to Wixon, both of whose disclosures are incorporated herein by reference. Use of such fabric softeners is particularly favored in the pastes of this invention due to the general absence of anionic surfactants in the pastes' formulations. Further, fragrances of various sorts, most of which are ketones or aldehydes containing substituted phenyl rings, can be added to the pastes. Also, corrosion-inhibition agents and anti-redeposition agents may be included in these pastes. Suitable anti-redeposition agents are disclosed in U.S. Pat. No. 3,558,499, issued to Galvin et al, U.S. Pat. No. 3,904,685, issued to Sahidi et al, U.S. Pat. No. 4,379,061, issued to Rabitsch et al and U.S. Pat. No. 4,510,066, issued to Saar, incorporated herein by reference.

DELIVERY FILMS

As noted in the foregoing, because of the physical nature of the paste detergent compositions, packaging and delivery of these compositions into the wash water cannot be implemented efficiently by most current commercial detergent packaging systems. As a result another preferred embodiment of this invention comprises a delivery system comprising (a) a water-soluble delivery pouch, which comprises a film prepared from at least one film-forming polymer and (b) an effective amount of a low temperature detergent paste which comprises a nonionic surfactant system and a builder.

Another advantage offered by these unit dosage packets or pouches is that the requirement for a phase stable paste detergent is less exacting, since the desired, premeasured amount is present in the packet or pouch and no mixing of the detergent to resuspend all solids is really necessary. Although the paste of the invention is ideally phase stable (less than 5%, most preferably less than 1% phase separation), use of pouches allows for some leeway and, hence, cost savings, in manufacture.

Particularly preferred films are castable, water-soluble films comprised of polyvinyl alcohols which have number average molecular weights from about 5,000–250,000. These polyvinyl alcohols are made by hydrolyzing polyvinyl acetate and generally have about 1 to 25 mole % residual acetate groups, more preferably 5 to 20 mole % residual acetate groups, and most preferably about 10 to 15 mole % residual acetate groups. Additionally, such polymers as polyvinyl alcohol copolymers, polyvinyl pyrrolidone, methyl cellulose, polyethylene oxide, gelatin and other film formers can be utilized. Examples of these films include U.S. Pat. No. 3,892,905, issued to Albert and U.S. Pat. Nos. 3,374,195 and 3,413,229, both to Bianco et al, all of which references are incorporated herein by reference. Plasticizers such as trimethylolpropane, glycerol, polyethylene glycol and others known to those skilled in the art can be included in the film to provide the film strength and flexibility required for producing, filling, shipping and storing the pouches prepared from these films. In addition other ingredients such as wetting agents, defoamers, and anti-blocking agents can be included in these films to aid in their manufacture and in the preparation of pouches made from these films.

The films included in this embodiment can have a thickness of from 1.0–5.0 mils, with the thickness and film material being selected to provide the optimum balance of film strength, cold water solubility and freedom from pinholing. It has been found that films with a thickness of 1.5–3.5 mils produced from polyvinyl alcohol with a weight average molecular weight of less than about 30,000 and with about 12 mole % residual acetate groups are preferred for this particular embodiment of the invention.

It has been further found that when pouches are produced from these preferred films and stored in contact with the detergent pastes of this invention, significant losses of impact strength can occur because of loss of film plasticizer from the film to the detergent. It has been found however, that the incorporation of small amounts of film plasticizers to the detergent paste composition itself surprisingly minimizes this loss of film plasticizer to the detergent. Thus, a further embodiment of this invention comprises a delivery means comprising (a) a water-soluble delivery pouch, and (b) an effective amount of a low-temperature-effective detergent paste which comprises a builder, a nonionic surfactant and 30% or less, based on the weight of the surfactant system, of at least one ingredient that is suitable for use as a film plasticizer, such as, e.g., trimethylolpropane, glycerol, polyethylene glycol or other alkylene glycols, for the film used to form the water-soluble pouch.

This invention is further exemplified by the examples set forth below which are intended to illustrate but not restrict the scope of the invention.

EXPERIMENTAL

Examples 1–10 show paste laundry detergent compositions that were prepared by blending the solid and liquid components in a low-shear Hobart mixer for about twenty minutes until the compositions were homogenous. Sodium sulfate was added as an inert ingredient in these compositions to help maintain the viscosity in the desired range and to allow evaluation of the effect of a highly soluble powder on the solubility rates of the compositions. About 54 grams of these compositions were placed in polyvinyl alcohol film pouches (88% hydrolyzed polyvinyl alcohol, weight average molecular weight of about 16,000, film thickness about 2.5 mils). Twenty-seven grams of the compositions were placed in each of two pouches measuring 2×3 inches, which were connected by a segment of the film to form a double pouch. Their solubility rates in cold water (70° F./normal agitation; 40° F./gentle agitation) in a washing machine were evaluated within 24 hours of preparation by visually observing any portions of undispersed detergent on ballast or in the machine after six minutes of gentle agitation in 68 liters of water with five pounds of ballast. The composition is considered to be soluble if less than 5% is visible after six minutes. Results are shown in Table I.

These results show that compositions with a ratio of zeolite to surfactant of less than about 2.0 dissolved in the wash at 70° F. Example 10, which exceeded this ratio and is outside the invention, left a significant residue in the wash. However, only those compositions with a ratio less than about 1.2 dissolved in the 40° F. wash. Surprisingly, the amount of water-soluble sodium sulfate in the composition had little effect on solubility. This indicates that addition of high amounts of a water soluble material would not tend to solubilize a detergent matrix containing insoluble builders.

TABLE I

| INGREDIENT | EXAMPLE 1 | 2 | 3 | 4 | 5 | 6 | 7 | 8 | 9 | 10 |
|---|---|---|---|---|---|---|---|---|---|---|
| | % IN COMPOSITION | | | | | | | | | |
| Zeolite A[1] | 50.0 | 42.0 | 33.3 | 23.0 | 49.0 | 42.0 | 38.0 | 35.0 | 66.6 | 69.5 |
| Sodium Sulfate | — | 15.1 | 32.4 | 53.1 | 12.1 | 19.4 | 37.1 | 34.1 | — | — |
| Nonionic Surfactant[2] | 49.1 | 42.0 | 33.3 | 23.0 | 38.9 | 37.7 | 24.0 | 30.0 | 32.5 | 29.6 |
| Fluorescent Whitening Agent[3] | 0.9 | 0.9 | 0.9 | 0.9 | 0.9 | 0.9 | 0.9 | 0.9 | 0.9 | 0.9 |
| Ratio of Zeolite to Surfactant | 1.0 | 1.0 | 1.0 | 1.0 | 1.3 | 1.1 | 1.6 | 1.2 | 2.0 | 2.3 |
| Soluble at 40° F. | Yes | Yes | Yes | Yes | No | No | No | No | No | No |
| Soluble at 70° F. | Yes | Yes | Yes | Yes | Yes | Yes | Yes | Yes | Yes | No |

[1]Valfor 100, supplied by PQ Corporation.
[2]Surfonic JL-80X, an ethoxylated, propoxylated linear alcohol supplied by Texaco Chemical Co.
[3]Tinopal 5BM-XC, supplied by Giba-Geigy.

While the composition of Examples 1–9 showed acceptable solubility, it is preferred to provide compositions with higher alkalinity to provide better soil/stain removal. Examples 11 and 12 show the benefits of adding a highly alkaline, water-soluble builder to the paste compositions of this invention. These compositions were prepared as before and the stain/soil removal ability of each was measured at 100° F./100 ppm hardness in a Tergotometer. Results are summarized in TABLE II.

TABLE II

| Ingredient | EXAMPLE 11 | 12 |
|---|---|---|
| | Dosage in the Wash Liquor (g/l) | |
| Zeolite A[1] | 0.42 | 0.40 |
| Sodium Silicate[2] | — | 0.13 |
| Neodol 23-6.5[3] | 0.03 | 0.03 |
| Surfonic JL-80X[4] | 0.22 | 0.21 |
| Enzyme[5] | 0.01 | 0.01 |
| Fluorescent Whitening Agent[6] | 0.01 | 0.01 |
| pH of wash liquor | 8.6 | 9.6 |
| % Clay Soil Removal[7] | 82.0[8] | 85.8[8] |
| % Mustard Stain Removal[7] | 50.0[8] | 57.30[8] |

[1]Valfor 100, supplied by PQ Corporation.
[2]Britesil C-24, a polymeric sodium silicate with an $SiO_2$:$Na_2O$ ratio of 2.4:1, supplied by PQ Corporation.
[3]An ethoxylated linear alcohol nonionic surfactant supplied by Shell Chemical Co.
[4]Surfonic JL-80X, an ethoxylated, propoxylated linear alcohol supplied by Texaco Chemical Co.
[5]Maxatase MP-375, an amylase-protease blend supplied by Gist-Brocades.
[6]Tinopal 5BM-XC, supplied by Ciba-Geigy.
[7]Measured colorimetrically using cotton fabric as the substrate.
[8]Least significant differences at the 95% confidence level are 2.0% for Clay Soil Removal and 2.7% for Mustard Stain Removal.

However, the use of highly alkaline builders in these paste detergent compositions can have deleterious effects when these compositions are packaged in water-soluble, polyvinyl alcohol films. Ten additional paste compositions (Examples 13–22) were prepared as before and were contacted with a polyvinyl alcohol film (as used in Examples 1–10) for four days in a room with a temperature of 90° F. and a humidity of 85%. After this exposure, the solubility of the film in 70° F. water was measured by visually observing its dissolution in a beaker of water after five minutes of moderate agitation. Based on studies with similar formulations under more realistic storage conditions (in a controlled environment room that cycles from 90° F./65% RH to 74° F./87% RH and back in a 24 hour period), products having a dissolution of 15–20% of the film after storage under these extreme conditions are considered commercially acceptable. The results, summarized in TABLE IV, show that the deleterious effects on film solubility can be minimized if the percentage of builder with 20% or more active alkalinity is kept below 25% in the compositions of this invention.

TABLE III

| INGREDIENT | % ACTIVE ALKALINITY | EXAMPLE 13 | 14 | 15 | 16 | 17 | 18 | 19 | 20 | 21 | 22 |
|---|---|---|---|---|---|---|---|---|---|---|---|
| | | % IN COMPOSITION | | | | | | | | | |
| Zeolite A | 2 | 66.4 | — | — | — | 56.4 | 56.4 | 58.9 | 61.4 | 61.4 | 56.4 |
| Sodium Carbonate | 29 | — | — | — | — | 10.0 | — | 7.5 | 5.0 | — | 7.5 |
| Sodium Silicate | 21 | — | 66.4 | — | — | — | 10.0 | — | — | 5.0 | 2.5 |
| Sodium Sesquicarbonate | 14 | — | — | 66.4 | — | — | — | — | — | — | — |
| Sodium Bicarbonate | 0.9 | — | — | — | 66.4 | — | — | — | — | — | — |
| Surfonic JL-80X | | 26.1 | 26.1 | 26.1 | 26.1 | 26.1 | 26.1 | 26.1 | 26.1 | 26.1 | 26.1 |
| Neodol 23-6.5 | | 3.7 | 3.7 | 3.7 | 3.7 | 3.7 | 3.7 | 3.7 | 3.7 | 3.7 | 3.7 |
| Enzyme | | 1.9 | 1.9 | 1.9 | 1.9 | 1.9 | 1.9 | 1.9 | 1.9 | 1.9 | 1.9 |
| Fluorescent Whitening Agent | | 0.9 | 0.9 | 0.9 | 0.9 | 0.9 | 0.9 | 0.9 | 0.9 | 0.9 | 0.9 |
| Fragrance | | 0.4 | 0.4 | 0.4 | 0.4 | 0.4 | 0.4 | 0.4 | 0.4 | 0.4 | 0.4 |
| Ultramarine Blue | | 0.1 | 0.1 | 0.1 | 0.1 | 0.1 | 0.1 | 0.1 | 0.1 | 0.1 | 0.1 |
| Phase Stabilizer[1] | | 0.5 | 0.5 | 0.5 | 0.5 | 0.5 | 0.5 | 0.5 | 0.5 | 0.5 | 0.5 |
| % of Builder with Greater than 20% Active Alkalinity | | | 66.4 | | | 10.0 | 10.0 | 7.5 | 5.0 | 5.0 | 10.0 |
| % Film Dissolved | | 100 | 0 | 100 | 100 | 25 | 98 | 72 | 95 | 100 | 73 |

[1]Deionized Water

The deleterious effect of highly alkaline builders on film solubility can be reduced by replacing a portion of these builders in the composition with less alkaline, water soluble builders. These latter builders also provide performance benefits as exemplified by the performance of Examples 23-25 as summarized in TABLE IV. The compositions were prepared as before and the stain/soil removal ability of each was measured at 100° F./100 ppm hardness in a Tergotometer.

TABLE IV

| Ingredient | EXAMPLE 23 | 24 | 25 |
|---|---|---|---|
| | Dosage in the Wash Liquor (g/l) | | |
| Zeolite A | 0.42 | 0.42 | 0.42 |
| Sodium Citrate dihydrate | — | 0.10 | — |
| Sodium Nitrilotriacetate | — | — | 0.10 |
| Surfonic JL-80X | 0.22 | 0.22 | 0.22 |
| Neodol 23-6.5 | 0.03 | 0.03 | 0.03 |
| Enzyme | 0.01 | 0.01 | 0.01 |
| Fluorescent Whitening Agent | 0.01 | 0.01 | 0.01 |
| % Clay Soil Removal[1] | 82.0[2] | 84.8[2] | 87.2[2] |
| % Tea Stain Removal[1] | 47.1[2] | 56.6[2] | 55.9[2] |

[1]Measured colorimetrically using cotton fabric as the substrate.
[2]Least significant differences at the 95% confidence level are 3.4% for Glay Soil Removal and 3.0% for Tea Stain Removal.

Example 26 was prepared as before, but the highly alkaline, water-soluble builder was partially replaced with a less alkaline, water-soluble builder. Surprisingly, this composition showed excellent solubility at both 40° F. and 70° F., good cleaning performance and good film stability. Phase stability testing with this formula showed no visibly detectable liquid layer on the surface of the paste after storage for fourteen days at 120° F.

| INGREDIENT | % IN COMPOSITION |
|---|---|
| Zeolite A | 33.2% |
| Sodium Sesquicarbonate | 18.4% |
| Sodium Citrate Dihydrate | 12.9% |
| Sodium Silicate | 1.5% |
| Surfonic JL-80X | 25.8% |
| Neodol 23-6.5 | 3.7% |
| Enzyme | 1.9% |
| Fluorescent Whitening Agent | 0.9% |
| Fragrance | 0.4% |
| Ultramarine Blue | 0.1% |
| Phase Stabilizer[1] | 1.2% |

[1]Deionized Water

Example 27 below was prepared in accordance with the teachings of U.S. Pat. No. 4,409,136, to further illustrate the advantages of the invention over the art. In Example 27, a paste detergent composition was prepared in accordance with U.S. Pat. No. 4,409,136 and contained a preferred nonionic surfactant, zeolite A and 12% added deionized water. The resulting composition was placed in a pouch constructed of the polyvinyl alcohol film described in previous examples and its rate of dissolution in 70° F. wash water was evaluated. The composition is considered to have acceptable solubility if less than 5% is visible after six minutes of gentle agitation in 70° F. wash water. Unlike Example 26 of the invention, which was soluble, the composition of Example 27 did not meet the solubility criteria and showed more than about 25% residue remaining.

EXAMPLE 27

| | |
|---|---|
| Zeolite A | 44.5 |
| Neodol 25-7[1] | 43.5 |
| Deionized Water | 12.0 |

[1]An ethoxylated linear alcohol nonionic surfactant supplied by Shell Chemical Company.

What is claimed is:

1. A phase stable concentrated non-phosphate paste detergent composition which is rapidly soluble in cold water comprising, by weight:
   (a) about 10-50% of at least one nonionic surfactant having a pour point less than about 65° F.;
   (b) about 5-70% of at least one water insoluble zeolite builder;
   (c) about 0-70% of at least one water soluble non-phosphate builder; and
   (d) less than about 10% added water as the only phase stabilizer;
   wherein the ratio of (b+c): a is greater than or equal to about 1.0; and
   wherein the ratio of b:a is less than about 2.0 said paste having a dissolution/dispersion rate in water at about 70° F. such that the paste dissolves within about 12 minutes or less with gentle or regular agitation.

2. The paste detergent as in claim 1 wherein said surfactant is selected from the group consisting of:
   linear and branched, primary and secondary ethoxylated alcohols with an average chain length of 6 to 16 carbon atoms and averaging about 2 to 10 moles of ethylene oxide per mole of alcohol; linear and branched, primary and secondary ethoxylated, propoxylated alcohols with an average chain length of about 6 to 16 carbon atoms and averaging about 1 to 10 moles of ethylene oxide and about 1 to 10 moles of propylene oxide per mole of alcohol; linear and branched alkylphenoxy (polyethoxy) alcohols with an average chain length of 8 to 16 carbon atoms and averaging 1.5 to 30 moles of ethylene oxide per mole of alcohol; ethoxylated, propoxylated linear and branched alkylphenols, with an average chain length of 8 to 16 carbon atoms, and averaging about 1 to 10 moles of ethylene oxide and about 1 to 10 moles of propylene oxide per mole of alcohol; and mixtures thereof.

3. The paste detergent of claim 1 wherein said water soluble builder is selected from the group consisting of: carbonates, borates, silicates, and the alkali metal and ammonium salts of any of the foregoing; polycarboxylates, polyhydroxy sulfonates, citrates, succinates, oxydisuccinates, polyacrylic acid, nitrilotriacetic acid, ethylenediaminetetraacetic acid, and the alkali metal and ammonium salts of any of the foregoing; and mixtures thereof.

4. The paste detergent of claim 1 further comprising (d) at least one adjunct selected from the following: a further surfactant which is a nonionic, anionic, cationic or amphoteric surfactant; phase stabilizers; fluorescent whitening agents; anti-redeposition agents; anti-corrosion agents; bleaches; dyes; pigments; fabric softeners; enzymes; and fragrances.

5. The paste of claim 4 wherein the fluorescent whitening agents include stilbene, styrylnaphthalene and styrene brighteners and their derivatives.

6. The paste of claim 4 wherein the pigment is ultramarine blue.

7. The paste of claim 4 wherein the enzymes include amylases, proteases and mixtures thereof.

8. The paste of claim 1 wherein the pour point of the surfactants is less than about 65° F.

9. The paste of claim 1 wherein the pour point of the surfactant is less than about 60° F.

10. The paste of claim 1 wherein the pour point of the surfactant is less than about 50° F.

11. The paste of claim 1 wherein the pour point of the surfactant is less than about 40° F.

12. The paste of claim 2 wherein the surfactant is a linear ethoxylated, propoxylated alcohol with an average chain length of about 6 to 16 carbon atoms and averaging about 1 to 10 moles of ethylene oxide and about 1 to 10 moles of propylene oxide per mole of alcohol; a linear ethoxylated, propoxylated alkylphenol with an average chain lenghth of 8 to 16 carbon atoms, and averaging about 1 to 10 moles of ethylene oxide and about 1 to 10 moles of propylene oxide per mole of alcohol; or a mixture thereof.

13. The paste of claim 14 wherein the surfactant is an ethoxylated, propoxylated alcohol with an average chain length of about 9–15 carbon atoms and averaging 5–10 moles of ethylene oxide and 0.5–3.0 moles of propylene oxide per mole of alcohol.

14. The paste of claim 13 further comprising another nonionic surfactant which is a linear ethoxylated alcohol with an average chain length of 12 to 13 carbon atoms and averaging 5 to 7 moles of ethylene oxide per mole of alcohol.

15. The paste of claim 1 wherein the surfactant comprises at least two nonionic surfactants, one of which has a pour point of less than about 40° F.

16. The paste of claim 2 wherein the ratio of b:a is less than or equal to 1.5.

17. A paste detergent as in claim 1 packaged in a water soluble film prepared from at least one film forming polymer of a size to make convenient unit dosage packets.

18. The paste detergent of claim 17 wherein the film is made from a plasticized polyvinyl alcohol with a molecular weight of about 10,000 to 100,000.

19. The paste detergent of claim 17 in which the paste detergent contains at least one film plasticizer in an amount of no more than about 30% by weight of the surfactant of (a), said plasticizer being present to enhance the film integrity.

20. The paste detergent of claim 17 wherein the water soluble builders of (c) include at least one builder with an active alkalinity of more than about 20%, said builder comprising less than 25% by weight of the paste.

21. A method for laundering fabrics comprising contacting in aqueous media, the fabrics with the paste detergent of claim 1.

22. A unit dosage detergent delivery means for low temperature laundering comprising:

(a) a concentraed non-phosphate paste detergent, which is rapidly soluble in cold water and which comprises, by weight:
  (i) about 15–45% of at least one nonionic surfactant;
  (ii) about 15–60% of at least one water insoluble zeolite builder;
  (iii) about 15–60% of at least one water soluble non-phosphate builder;
  wherein the ratio of (ii+iii): i is greater than or equal to about 1.0;
  wherein the ratio of ii:i is less than about 2.0; and wherein the amount of iii which includes a builder whose active alkalinity is greater than 20% does not exceed about 25% of the total weight of the detergent; and (b) A water sosluble film packet prepared from at least one film-forming polymer encasing (a), said film packet tending to become insoluble in high alkalinity; said paste having a dissolution/dispersion rate in water at about 70° F. such that the paste dissolves/disperses within about 12 minutes or less with gentle or regular agitation.

23. The delivery means of claim 22 wherein the paste detergent of (a) further contains (iv) at least one film plasticizer in an amount of no more than about 30% by weight of the surfactant of (i).

24. The delivery means of claim 22 wherein the water soluble builder is a mixture of (A) at least one alkaline builder, which has active alkalinity of more than about 20%, and (B) at least one less alkaline builder.

25. The delivery means of claim 24 wherein (A) is an alkali metal silicate and (B) is an alkali metal citrate.

26. The delivery means of claim 24 wherein (A) is an alkali metal silicate and (B) is the sodium salt of nitrilotriacetic acid.

27. The delivery means of claim 24 wherein (A) is an alkali metal silicate and (B) is an alkali metal sesquicarbonate.

28. A method of cleaning fabrics in cold water comprising:

contacting said fabrics in said cold water with a substantially nonaqueous, phase stable concentrated paste detergent composition which is rapidly soluble in said cold water, wherein said composition comprises, by weight:

(a) about 10–50% of at least one nonionic surfactant;

(b) about 5–70% of at least one water insoluble zeolite builder;

(c) about 0–70% of at least one water soluble non-phosphate builder; and (d) less than about 10% added water as the only phase stabilizer;

wherein the ratio of (b+c): a is greater than or equal to about 1.0; and wherein the ratio of b:a is less than about 2.0; said paste having a dissolution/dispersion rate in water at about 70° F. such that the paste dissolves/disperses within about 12 minutes or less with gentle or regular agitation; and removing said paste composition from said fabrics.

29. A unit dosage delivery means for low temperature laundering comprising:

(a) a water soluble film packet, said film prepared from at least one film forming polymer, said packet tending to become insoluble in high alkalinity, said packet enclosing a premeasured, single wash load amount of (b) a concentrated non-phosphate detergent, which is rapidly soluble in cold water, said detergent comprising, by weight:

(i) about 15–45% of at least one nonionic surfactant which is derived from linear or branched alcohols with an average chain length of 6–16 carbon atoms and which is alkoxylated with an average of 1–10 moles of ethylene oxide and 1–10 moles of propylene oxide per mole of alcohol;

(ii) about 15–60% of at least one water insoluble zeolite builder;

(iii) about 15–60% of at least one water soluble non-phosphate builder, at least a portion of which has an active alkalinity greater than about 20%;

wherein the ratio of (ii+iii): i is greater than or equal to about 1.0;

wherein the ratio of ii:i is less than about 2.0; and wherein the amount of said alkaline builder with active alkalinity greater than about 20% of iii does to exceed about 25% of the total weight of the detergent in order to maintain solubility of said packet.

* * * * *